United States Patent [19]

Miesner

[11] Patent Number: 4,841,866

[45] Date of Patent: Jun. 27, 1989

[54] TRACER SHOTGUN SHELL

[76] Inventor: Delbert W. Miesner, 1375 Baker NE., Salem, Oreg. 97303

[21] Appl. No.: 305,071

[22] Filed: Feb. 2, 1989

[51] Int. Cl.[4] ..... F42B 7/00

[52] U.S. Cl. ..... 102/458; 102/513

[58] Field of Search ..... 102/458, 513

[56] References Cited

U.S. PATENT DOCUMENTS

| | | | |
|---|---|---|---|
| 1,887,990 | 11/1932 | Brownsdon et al. | 102/458 |
| 3,262,390 | 7/1966 | Cowles et al. | 102/42 |
| 3,405,638 | 10/1968 | Stoner | 102/87 |
| 3,760,735 | 9/1973 | Schmitt | 102/87 |
| 4,080,899 | 3/1978 | Luban | 102/42 R |
| 4,389,939 | 6/1983 | Ofuji | 102/458 |
| 4,553,481 | 11/1985 | Ricci | 102/458 |

*Primary Examiner*—Harold J. Tudor

*Attorney, Agent, or Firm*—John F. Ingman

[57] ABSTRACT

A tracer shotgun shell includes an improved tracer element and a single, integral wad member, which supports the tracer element within a shot charge. The tracer element is in the form of a spherical ball with a cylindrically-shaped, radially extending tail. A hole is formed through the tail and into the ball, past its center, and an igniter compound is positioned centrally within the ball. A preferred form of the igniter compound includes a mixture, by weight, of 87% barium peroxide, 11% magnesium, and 2% strontium nitrate. The single, integral wad member includes a transverse base section, having a downwardly extending perimetric flange; an upper transverse section; and a stem interconnecting and spacing the two sections. A tracer element mounting platform is formed centrally atop the upper transverse section, and extends into the charge of shot so as to permit shot to laterally encircle the platform. The tracer element mounting platform incorporates a centered concave depression corresponding in shape to the outer surface of the tracer element spherical ball, which provides extended surface contact between the tracer element and its mounting platform. A hole is centrally formed within the concave depression, to accept the tail of the tracer element, which connects with an ignition passage extending axially through the wad member.

4 Claims, 1 Drawing Sheet

TRACER SHOTGUN SHELL

BACKGROUND OF THE INVENTION

1. Field of the Invention

This invention involves a tracer shotgun shell, and, more particularly, a shotgun shell having a tracer element and a single wad member which centers the tracer element within the pattern of the shot.

2. Description of the Prior Art

Various means have been developed to allow the shotgun shooter to visually follow the shot as it proceeds towards the target, all with limited success. Certain developments have attempted to tag the individual shot. U.S. Pat. No. 3,760,735, issued to P. F. Schmitt, discloses a shotgun shell wherein the shot is in the form of pellets, preferably of rubber or plastic, to each of which is secured an elongated tail of fluorescent material which is one to three inches long. U.S. Pat. No. 4,080,899, issued to W. L. Luban, discloses shot pellets which are encapsulated with light reflective coatings to permit nighttime tracking. U.S. Pat. No. 4,389,939, issued to H. Ofuji discloses a shotgun cartridge with each shot pellet being coated with an ignitable illuminant or smoking agent, and the cartridge including a solid igniting agent for igniting the illuminant or smoking agent. U.S. Pat. No. 4,553,481, issued to V. Ricci, on the other hand, discloses a wad for a shotgun shell having an upper cylindrical compartment for holding shot and a lower compartment which includes two chemical compounds in individual frangible containers, so that, when the shell is fired, the chemicals will mix to create a chemiluminescent compound which is ejected from the barrel of the shotgun along with the wad and shot.

Others have designed a single tracer element or projectile mounted within the shotgun shell which is ignited by the propellent powder of the shell and which is propelled from the shotgun along with the shot. Examples of such design are provided by U.S. Pat. No. 3,262,390, issued to R. I. Cowles, et al, and U.S. Pat. No. 3,405,638 issued to J. A. Stoner, Jr.. Such single tracer elements, however, in practice either do not retain the desired trajectory or do not remain at the center of the shot pattern during flight. It is this type of tracer shotgun shell that offers the most promise, and which is improved significantly and uniquely by the instant invention.

What is needed is a tracer shotgun shell which allows the shooter to visually follow the flight of the shot through the use of a tracer element which, following the same trajectory as the shot, remains centered within the shot pattern, neither leading nor lagging the shot string, so that it arrives at the target at the same time as the shot. The tracer shotgun shell should be simple and economical to manufacture.

SUMMARY OF THE INVENTION

The present invention provides a tracer shotgun shell which is designed to satisfy the aforementioned needs. The invention involves an improved tracer element and single wad means for positioning and holding the tracer element within the shell.

Accordingly, the tracer shotgun shell, in its preferred embodiment, includes a hollow cylindrical shell, with a primer positioned in its base, and propellant powder within the shell and adjacent to the base and primer; a single, integral wad member, which supports a tracer element and a shot charge; a tracer element; and a charge of shot; the mouth of the shell being crimped to retain the contents until firing.

A tracer element is provided in the form of a spherical ball with a cylindrically shaped tail radially extending therefrom. A hole is formed centrally through the tail and into the spherical ball so as to extend past the center of the ball, and an igniter compound is positioned centrally within the spherical ball. A preferred form of the igniter compound includes a mixture, by weight, of eighty-seven percent barium peroxide, eleven percent magnesium, and two percent strontium nitrate.

The single, integral wad member includes a circular, powder-covering, transverse base section, having a downwardly extending perimetric flange; a circular, shot-supporting, upper transverse section; and a stem interconnecting and spacing apart the powder-covering transverse base section and the shot-supporting upper transverse section. A tracer element mounting platform is formed centrally atop the shot-supporting upper transverse section, and extends into the charge of shot so as to permit shot to transversely encircle the platform. The tracer element mounting platform incorporates a centered concave depression corresponding in shape to the outer surface of the tracer element spherical ball so as to provide extended surface contact between the tracer element and the tracer element mounting platform. Centrally formed within the concave depression is a hole of such diameter to accept the cylindrical tail of the tracer element, this hole connecting with a tracer element ignition passage which extends through the powder-covering transverse base section, the stem and the shot-supporting upper transverse section. Side walls extend upwardly from the perimeter of the upper transverse section to contain the shot and protect the barrel of the shotgun upon firing; the side walls are longitudinally sectioned to create flaps which cause early separation of the wad from the shot and tracer element after leaving the shotgun barrel.

DESCRIPTION OF THE PREFERRED EMBODIMENT

Figure 1:
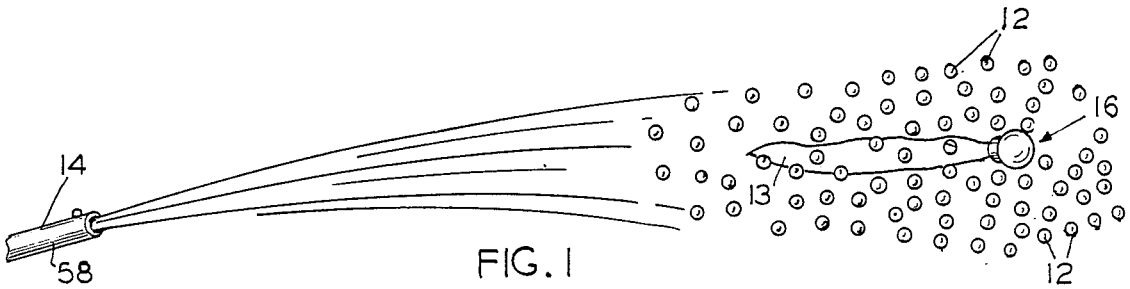
FIG. 1 illustrates shot with an accompanying tracer element as fired from a shotgun using a tracer shotgun shell.

Referring now to the drawings, there is shown in FIG. 1 a pictorial view of a charge of shot 12, having been fired from a shotgun 14 using the tracer shotgun shell 10, wherein an ignited tracer element 16 is effectively centered within the pattern of shot 12 where it emits a visible trail 13 of burning material so as to make its progress, and that of the shot 12, visible to the user of the shotgun 14.

Figure 2:
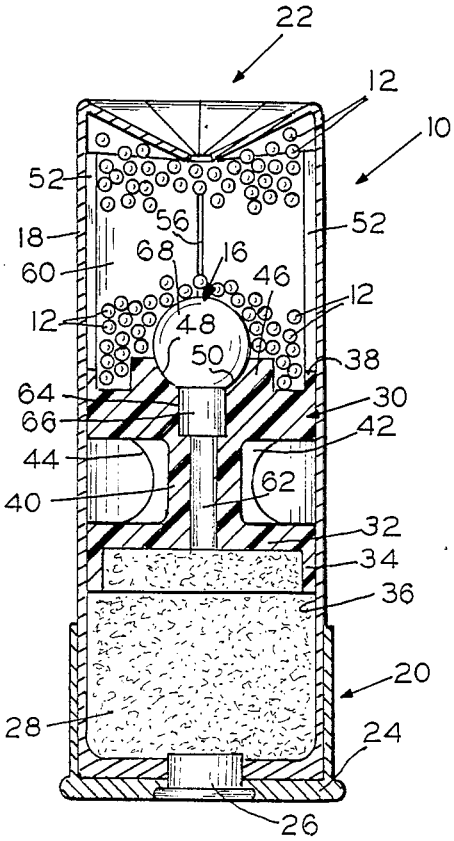
FIG. 2 illustrates a sectioned side view of the tracer shotgun shell.
Figure 3:
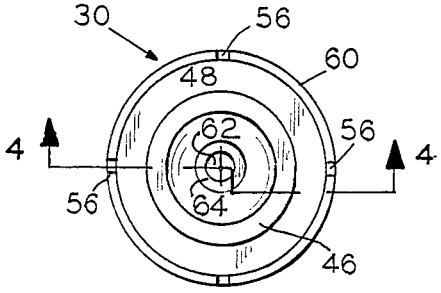
FIG. 3 illustrates a top end view of the integrated wad of the tracer shotgun shell.
Figure 4:
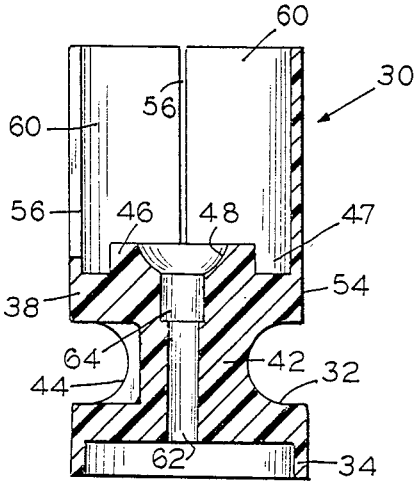
FIG. 4 illustrates a cross-section view of the integrated wad of the tracer shotgun shell, as seen at line 4—4 of FIG. 3.

FIG. 2 provides a cross sectional view of the preferred embodiment of the tracer shotgun shell 10. A hollow cylindrical shell 18, made of paper or plastic material, has a base 20 and a folding mouth 22. A metal base cap 24, commonly brass, surrounds and supports the base 20 of the shell 18, and a primer 26 extends therethrough so as to be in contact with propellant powder 28 which is held within the base 20.

A single, integral wad 30 is positioned adjacent to the powder 28, as illustrated. The wad 30 includes a circular powder-covering transverse base section 32 having a downwardly extending perimetric flange 34 which, when the powder 28 is ignited, expandingly presses outward against the inner surface 36 of the shell 18 to minimize the escape of expanding propellant gases about the periphery of the wad 30 base section 32. A circular shot-supporting upper transverse section 38, which also supports the tracer element 16, forms a second element of the wad 30. A stem 40 of substantially reduced diameter interconnects and spaces apart the two transverse sections 32 and 38. The stem 40 may have a plurality, preferably four (4), of support members 42 which longitudinally radiate along the axis of the stem 40, the outer face 44 of the support members 42 being concavely formed so as to provide a weaker portion for axial collapse of the stem 40. Such axial collapse has been found advantageous in providing a cushioning effect in the translation of movement of the base section 32 to the shot supporting member 38 and therefore minimization of disruption of the pattern of shot 12 within and outside of the shotgun 14.

Centrally mounted upon the circular shot-supporting transverse section 38 of the wad 40 is a tracer element mounting platform 46 which extends into the charge of shot 12 and which is formed to position and hold the tracer element 16. The extension of the tracer element mounting platform 46 forms an annulus which permits shot 12 to transversely encircle the tracer element mounting platform 46 and thus the tracer element 16. The tracer element mounting platform 46 incorporates a concave depression 48, the curvature of which corresponds to the curvature of the surface of the tracer element 16 so as to provide extended surface contact 50 between the tracer element 16 and the tracer element mounting platform 46. Such design creates a positive gas seal wherein, upon firing, the forward acceleration of the wad 30 causes the tracer element to be driven against the extended contact surface 50, and thus blocks high pressure gases from escaping through the ignition passage 62, described subsequently, preventing loss of velocity and distortion of the pattern of shot 12. Additionally, the extended surface contact 50 between the concave depression 48 and the tracer element 16 will importantly preclude the intrusion of individual shot 12 between the tracer element 16 and the tracer element mounting platform 46 and thus maintains the tracer element 16 transversely centered and pointing forward within the wad 30 after firing. Designs not having the tracer element mounting platform 46 which intrudes into the charge of shot 12 and the extended surface contact 50 of a matching concave depression 48 tend to have their tracer element 16 forced out of its central location immediately after firing, and thus do not maintain the desired "center of the shot pattern" position during flight.

To further contain the shot 12 in a desired pattern, and to protect the inner surface of the barrel of the shotgun 12, a side wall 52 extends upwardly from the perimeter 54 of the shot supporting transverse section 38. This side wall 52 has a plurality of longitudinal slits 56, preferably four (4), forming flaps 60 so that when the wad 30 exits the barrel 58 of the shotgun 14, air pressure will bend the flaps 60 outwardly, increasing wind resisitance to the wad 30 and causes it to predictably separate from the shot 12 and the tracer element 16.

A tracer element ignition passage 62 extends within the wad 30 through the powder-covering transverse base section 32, the stem 40 and the shot-supporting upper transverse section 38 and its tracer element mounting platform 46. For a 12 gauge tracer shotgun shell 10, a preferred diameter of said passage 62 is 3/32 inches. Centrally within the concave depression 48, the ignition passage 62 is enlarged 64 to a sufficeint diameter to accept the tail 66 of the tracer element 16.

Figure 5:
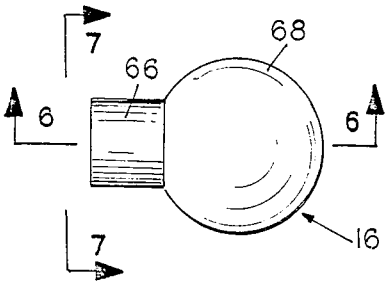
FIG. 5 illustrates a side view of the tracer element of the tracer shotgun shell.
Figure 6:
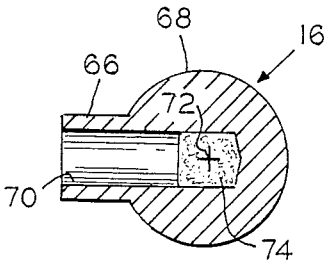
FIG. 6 illustrates a cross sectional view of the tracer element as seen at line 6—6 of FIG. 5.
Figure 7:
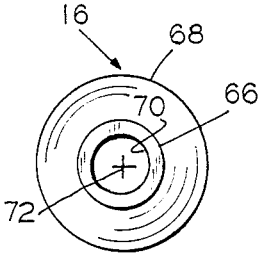
FIG. 7 illustrates an end view of the tracer element as seen at line 7—7 of FIG. 5.

As seen in FIGS. 5, 6, and 7, the preferred tracer element 16 is in the shape of a spherical ball 68 with a cylindrically shaped tail 66 radially extending therefrom. A hole 70 is formed centrally through the tail 66 and into the spherical ball 68 so as to extend past the center 72 of the ball 68. An igniter compound 74 is placed centrally within the spherical ball 68 so that its burning will not significantly change the distribution of weight within the tracer element 16. A preferred form of igniter compound 74 comprises approximately 87% barium peroxide, 11% magnesium, and 2% strontium nitrate.

The tracer element 16 is designed to ballistically match the shot 12 loaded into the tracer shotgun shell, and thus replicate its trajectory, staying in the center of the shot pattern. For a load of $7\frac{1}{2}$-size shot 12, an aluminum tracer element 16 has a spherical ball 68 of $\frac{3}{8}$-inch diameter and a cylindrical tail 66 of 3/16-inch diameter and $\frac{1}{8}$-inch length wherein the hole 70 is of $\frac{1}{8}$-inch diameter and extends into the ball 68 1/16-inch past the center. The igniter compound 74 thus is cylindrically shaped with a $\frac{1}{8}$-inch diameter and a length of $\frac{1}{8}$-inch.

It is thought that the tracer shotgun shell of the present invention and its many attendant advantages will be understood from the foregoing description and that it will be apparent that various changes may be made in form, construction and arrangement of the parts thereof without departing from the spirit and scope of the invention or sacrificing all of its material advantages, the forms hereinbefore stated being merely exemplary embodiments thereof.

I claim:

1. A tracer shotgun shell, comprising:

a. a hollow cylindrical shell, having a base and a mouth;

b. a primer centrally positioned on said base, and propellant powder within said shell and adjacent to said base and primer;

c. a charge of shot, adjacent to said mouth;

d. a wad member substantially positioned within said shell between the propellant and charge of shot, said wad member including:

(1) a circular, powder-covering transverse base having a downwardly extending perimetric flange;

(2) a circular, shot supporting upper transverse section;

(3) a stem, which interconnects and spaces said powder-covering transverse base and said shot-supporting upper transverse section;

(4) a tracer element mounting platform formed on said shot supporting upper transverse section and extending into said charge of shot, said platform being of sufficiently less diameter that the shot-supporting upper transverse section to permit shot to transversely encircle said platform;

(5) said tracer element mounting platform including a central concave depression; and (6) an ignition passage extending through the powder-covering transverse base, the stem and the shot-supporting upper transverse section and its tracer element mounting platform, and penetrating said concave depression;

e. a tracer element comprising a ball with a cylindrically shaped tail radially extending therefrom, with:

(1) a hole formed centrally through the tail and into the ball so as to form a cavity which extends past the center of the ball; and (2) an igniter compoud positioned centrally within the ball in said cavity;

f. where the tail of the tracer element fits within the ignition passage, the surface of the ball adjacent to the tail fits closely within the concave depression of the tracer element mounting platform, and the portion of the tracer element opposing the tail extends on the mounting platform into the charge of shot.

2. The tracer shotgun shell, as recited in claim 1, wherein the ball is spherically shaped and the concave depression of the tracer element supporting platform also is spherical in shape and substantially identical to the surface of said spherical ball of the tracer element, so as to present an extended surface contact area between the tracer element and the mounting platform.

3. The tracer shotgun shell, as recited in claim 1, where the igniter compound is substantially a mixture, by weight, of eighty-seven percent barium peroxide, eleven percent magnesium and two percent strontium mixture.

4. The tracer shotgun shell as recited in claim 1, where the wad member additionally includes a sidewall extending from the perimeter of the shot-supporting upper transverse section towards the mouth of the shell, said sidewall having a plurality of longitudinal slits formed therein.

* * * * *